United States Patent [19]

Dollinger et al.

[11] 3,954,633

[45] May 4, 1976

[54] ANTISTATIC AND LUBRICATING AGENTS FOR THE PROCESSING OF FIBERS

[75] Inventors: Gustav Dollinger, Egelsbach; Ulrich Cuntze, Hofheim, Taunus; Rolf Kleber, Neu-Isenburg, all of Germany

[73] Assignee: Hoechst Aktiengesellschaft, Frankfurt am Main, Germany

[22] Filed: July 10, 1974

[21] Appl. No.: 487,314

[30] Foreign Application Priority Data

July 13, 1973 Germany ..... 2335675

[52] U.S. Cl. ..... 252/8.8; 252/8.7

[51] Int. Cl.[2] ..... D06M 13/36; D06M 13/46

[58] Field of Search ..... 252/8.8, 8.7

[56] References Cited

UNITED STATES PATENTS

| | | | |
|---|---|---|---|
| 3,507,690 | 4/1970 | Walker | 252/8.8 X |
| 3,738,864 | 6/1973 | Altau | 252/8.8 |
| 3,749,674 | 7/1973 | Jones et al. | 252/8.8 X |

FOREIGN PATENTS OR APPLICATIONS

| | | | |
|---|---|---|---|
| 808,265 | 1/1959 | United Kingdom | 252/8.8 |

*Primary Examiner*—Donald E. Czaja
*Assistant Examiner*—Edward Woodberry
*Attorney, Agent, or Firm*—Connolly and Hutz

[57] ABSTRACT

Peralkylated propylenediamines having one long-chain alkyl or alkenyl group are antistatic agents for fibers.

2 Claims, 1 Drawing Figure

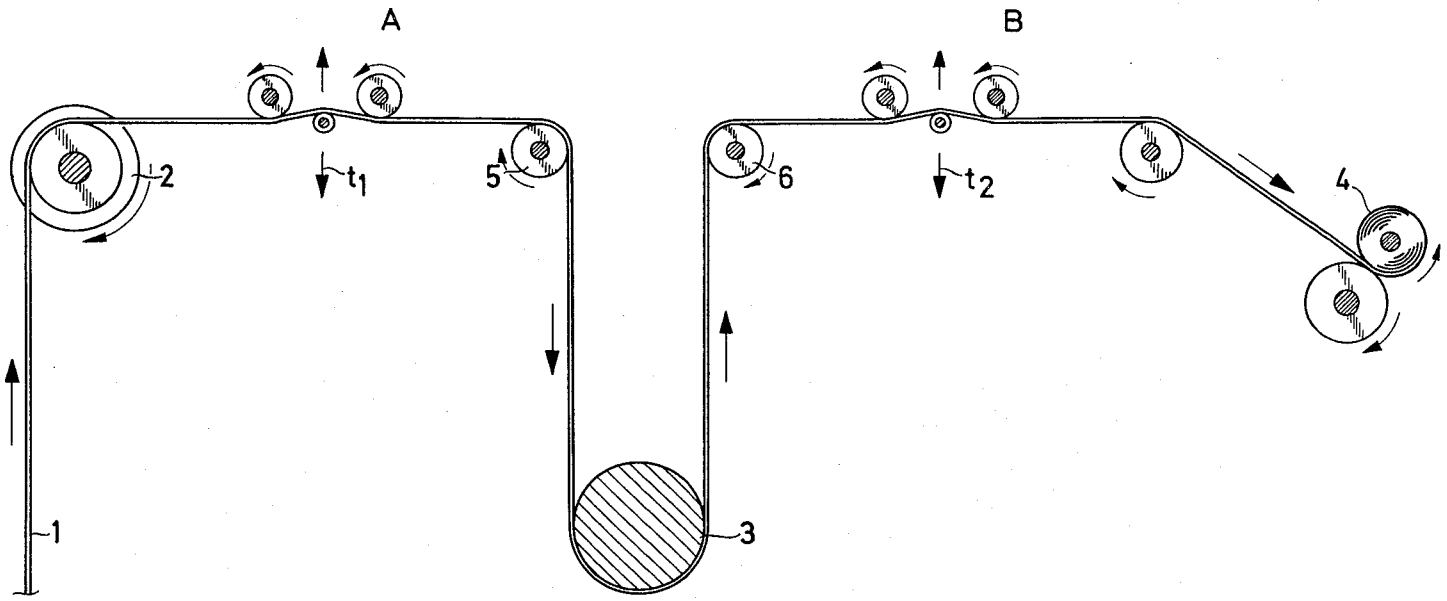
A
B
1
2
3
4
5
6
$t_1$
$t_2$

ANTISTATIC AND LUBRICATING AGENTS FOR THE PROCESSING OF FIBERS

The present invention relates to a process and agents for the processing of fibers.

It has been known for a long time that cation active substances, such as quaternary ammonium compounds, are useful as components having an antistatic effect in fiber processing agents to improve the sliding of fibers and filaments over the thread guiding aggregates.

There are three ways in which antistatics counteract the electrostatic charge (cf. H. Rath, Lehrbuch der Textilchemie, 3rd edition, 1972, page 340 et seq.). Firstly, they reduce the friction coefficient of the fiber, secondly, they increase the surface conductivity of the fiber and thirdly they increase the dielectric constant of the medium between the two bodies in friction, the system fiber-friction body being considered as condensator.

Surface active anionic or cationic products have an effect which is the more antistatic the more pronounced their polar or polarizable nature and the longer the fat chain is on which the products are based (cf. Rath, loc. cit. and page 792 et seq.). The products which are to be used must readily and easily be soluble in water and, preferably, be in liquid form so that they can more easily be transported in containers and carried through pumps.

A number of commercial products which are widespread because of their good antistatic effects are quaternary ammonium compounds having long fatty acid radicals, for example, a condensation product of stearic acid with diethylene triamine which is then permethylated with dimethyl sulfate. These products are in the form of pastes which are only dissolved by boiling with water and can then be applied.

Now, it was found that compounds of the formula I

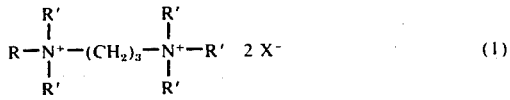

(1)

in which R stands for a long-chain alkyl or alkenyl radical, the radicals R′ stand for identical or different lower alkyl radicals and X stands for a chloride, a lower alkyl sulfate or tosylate ion, impart to fibers high antistatic values, can be brought into highly concentrated stable liquid compositions, are readily soluble in water and thus do not show the disadvantages mentioned of known products.

Compounds of the formula I in which the radical R stands for a fat alkyl or alkenyl radical of 8–20 carbon atoms the main portion of which shows 12–18 carbon atoms, are preferred. Those radicals are derived, for example, from tallow oil, coconut oil, soy bean oil and palm kernel oil fatty acids. The radicals R′ are, preferably, identical and are, preferably, ethyl and, especially, methyl groups. Preferred anions are etho- and, especially, metho sulfate, as well as chloride. It is not necessary that these compounds are in a 100 % peralkylated form; a low amount of compounds in which a radical R′ is replaced by hydrogen, is not detrimental.

The products which are very readily soluble in cold water of about 8°–20°C in the form of their liquid concentrates having a content of active substance of up to about 50 % by weight impart to fibers of every nature excellent antistatic properties accompanied by a soft and pleasant feel when they are applied in an amount of about 0.1 to about 5 %, preferably about 0.2 % to about 2 % by weight. They can be applied in known manner by spraying, immersion, padding or by means of lick rollers.

The high substantivity of the compounds of formula I allows to apply the products from a long bath (of low concentration) for example, in a dyeing process.

Their use in the fiber preparation can be effected at the same time with usual smoothening agents, for example mineral and paraffin oils, ester oils, emulsifiers and others.

Suitable fibers are native fibers, such as cellulose fibers, especially cotton, and wool, moreover, partly synthetic fibers, such as regenerated cellulose or acetyl cellulose, preferably, however, synthetic fibers, such as polyester, especially of the type of polyethylene glycol terephthalate, polyamide, especially polyamide 6 and polyamide 6,6 and polyacrylonitrile or copolymers containing predominantly acrylonitrile units.

It is surprising that the readily soluble compounds of the formula I have a good softening and smoothening effect on the fiber although as liquid products they do not form a film round the fiber as it is produced by the pasty and film-forming known antistatics, for example, the condensation product of stearic acid with diethylene triamine permethylated with dimethyl sulfate.

The following examples illustrate the invention, the parts and percentages being by weight unless stated otherwise:

EXAMPLE 1

The following solutions were applied to a polyamide 6 filament (dtex 200 f 20) by means of a lick roller, maintaining a coating of 0.5 %:

a. a 1 % aqueous solution of a permethylated condensation product of 1 mol of diethylene triamine with 1 mol of stearic acid (state of the art)

b. a 1 % aqueous solution of

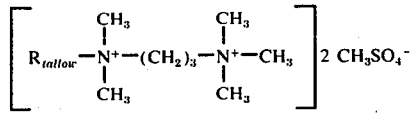

($R_{tallow}$ = radical of about 14–18 carbon atoms derived from the tallow fatty acid, predominantly $C_{16}H_{33}$, $C_{18}H_{35}$ and $C_{18}H_{37}$).

The filament so prepared was dried at 80°C. It showed the following properties:

| | a | b |
|---|---|---|
| corrosion[1] | heavy rusting | indifferent, like water |
| dynamic friction | 0.38 | 0.36 |
| antistatic behaviour (Megohm) | 100 | 50 |

[1] "Herbert"-test (cf. U.S. Patent No. 3,556,994, column 4, lines 44 et seq., using stell plates and steel filings).

The product (b) of the instant invention which has slightly superior values of corrosion, friction and antistatic behaviour is easily and clearly soluble in water in the form of the 47 % liquid concentrate (A) whereas the comparison substance (a) as a pasty mass must at first be molten on a pick-up tube with hot steam.

Similar effects are obtained when instead of the product (b) the following compound (c) is used:

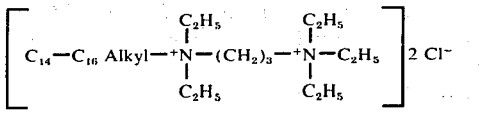

The dynamic friction was measured by means of the device described as follows: (cf. drawing). The filament (1) runs from the filament feeding roll over a filament brake (2) which provides a constant tension of 50 p, to the first measuring head (A) and therefrom over a friction body (3) made of hard chrome plated stainless steel to the second measuring head (B) wherefrom the filament is passed to the take-up roll (4).

The dynamic friction coefficient $f$ results from the filament tension $t_1$ (before the friction body (3)) and $t_2$ (after the friction body (3)) according to the following equation:

$$f = 1/\alpha\,(\ln t_2 - \ln t_1)$$

in which $\alpha$ is the angle of contact around the roll, which was adjusted with the aid of guide rollers (5) and (6) in this case to 180°. The value indicated from the dynamic friction (filament-metal-friction) is the average of measuring values with draw-off speeds of 20 and 120 m/sec.

EXAMPLE 2

Polyacrylonitrile flocks were treated in separated dye-baths with a goods-to-liquor ratio of 1 : 20 and at a temperature of 40°C for 30 minutes with aqueous solutions of the following compounds:

a. pasty mixture of a commercial ethoxylated tertiary sulfonium compound having a long-chain fat radical and triethanolamine stearate (state of the art)

b. compound of the formula

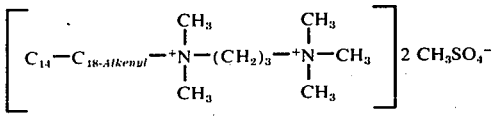

The amounts used are each time 5 g/l. In this case, the comparison substance must at first be molten on the pick-up tube by means of hot steam and then before be dissolved separately by boiling over a long period, whereas the compound (b) according to the instant invention can be added to the dye-bath directly as liquid concentrate (of 48 %).

The flocks were then centrifuged to a liquor-pick-up of about 70 %, calculated on the dry weight of the flocks and dried at 110°C. The flocks finished with compound (b) show a pleasant smooth feel whereas the material treated with the substance (a) has a slightly rough surface.

Antistatic effects: (Megohm) : (a) 15; (b) 10.

The following preparation prescriptions show advantageous processes for the preparation of stable liquid compositions of the substances to be used according to the invention:

A. 504 g (= 4 mols) of dimethyl sulfate were added dropwise during 2 hours at 60°–75°C to 345 g (= 1 mol) of tallow oil propylene diamine in 730 g of water. By adding dropwise at the same time 360 g of 33 % sodium hydroxide solution in total the pH was maintained above 9. Having terminated the addition of dimethyl sulfate neutralization with glacial acetic acid followed and a liquid was obtained the content of solid body of which was determined to be 47 %.

B. 192 g (= 1.25 mol) of diethyl sulfate were added dropwise during 2 hours at 60°–75°C to 86.3 g (= 0.25 mol) of tallow fat propylene diamine in 265 g of water. By adding dropwise at the same time 102 g of 33 % sodium hydroxide solution in total the pH was maintained above 9. Having terminated the addition of diethyl sulfate neutralization with glacial acetic acid followed and a liquid was obtained the content of solid body of which was determined to be 48 %.

C. 630 g (= 5 mols) of dimethyl sulfate were added dropwise for 2 hours at 60°–75°C to 274 g (= 1 mol) of coconut oil propylene diamine in 740 g of water. By adding dropwise at the same time 540 g of 33 % sodium hydroxide solution in total the pH was maintained above 9. Having terminated the addition of dimethyl sulfate neutralization with glacial acetic acid followed and a liquid was obtained the content of solid body of which was determined to be 49 %.

D. 755 g (= 6 mols) of dimethyl sulfate were added dropwise within 1 hour at 60°–75°C to 398 g (1.275 mol) of stearyl propylene diamine in 850 cc of water. By adding dropwise at the same time in total 540 g of 33 % sodium hydroxide solution the pH was maintained above 9. Having terminated the addition of dimethy sulfate neutralization with glacial acetic acid followed and a liquid was obtained the content of solid body of which was determined to be 49 %.

We claim:

1. A liquid antistatic fiber lubricating agent essentially consisting of 20 to 50% by weight of a compound of the formula

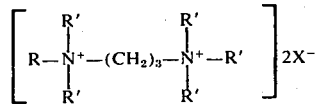

in which R is alkyl or alkenyl of 8 to 20 carbon atoms, the R′ are identical or different lower alkyls and X is chloride, lower alkylsulfate or tosylate and of 50 to 80% of weight of water.

2. An agent as defined in claim 1 essentially consisting of 0.1 to 5% by weight of a compound of claim 1 and 99.9 to 95% by weight of water.

* * * * *